US012038210B2

(12) United States Patent
Sakamoto et al.

(10) Patent No.: US 12,038,210 B2
(45) Date of Patent: Jul. 16, 2024

(54) CHILLING UNIT

(71) Applicant: Mitsubishi Electric Corporation, Tokyo (JP)

(72) Inventors: Nobuhide Sakamoto, Tokyo (JP); Takahito Hikone, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 354 days.

(21) Appl. No.: 17/611,776

(22) PCT Filed: Aug. 7, 2019

(86) PCT No.: PCT/JP2019/031085
§ 371 (c)(1),
(2) Date: Nov. 16, 2021

(87) PCT Pub. No.: WO2021/024408
PCT Pub. Date: Feb. 11, 2021

(65) Prior Publication Data

US 2022/0252313 A1 Aug. 11, 2022

(51) Int. Cl.
*F25B 41/385* (2021.01)

(52) U.S. Cl.
CPC ..... *F25B 41/385* (2021.01)

(58) Field of Classification Search
CPC ..... F25B 41/385
See application file for complete search history.

(56) References Cited

U.S. PATENT DOCUMENTS

2006/0080992 A1* 4/2006 Zhou ..... F25D 23/126 62/389
2010/0242532 A1* 9/2010 Kopko ..... F25B 41/00 62/513
2017/0205085 A1* 7/2017 Lu ..... F24F 1/18
2018/0080667 A1* 3/2018 Nishimoto ..... F24F 1/16
2019/0226735 A1* 7/2019 Bissell ..... F25B 47/025
2019/0264957 A1* 8/2019 Petersen ..... F25B 25/005
(Continued)

FOREIGN PATENT DOCUMENTS

EP 1 674 807 * 6/2006
EP 1 674 807 A2 6/2006
(Continued)

OTHER PUBLICATIONS

Office Action dated Oct. 25, 2022 issued in corresponding JP Patent Application No. 2021-538612 (and English machine translation).
(Continued)

*Primary Examiner* — Henry T Crenshaw
(74) *Attorney, Agent, or Firm* — Posz Law Group, PLC

(57) ABSTRACT

A chilling unit includes a casing, a refrigerant circuit in which a compressor, a heat-source heat exchanger, a first expansion unit, a second expansion unit, and a refrigerant-to-heat medium heat exchanger are connected by a refrigerant pipe and through which refrigerant flows, the refrigerant circuit being placed in the casing, and an injection circuit in which a portion between the first expansion unit and the second expansion unit is connected to the compressor by an injection pipe, the injection circuit being placed in the casing.

8 Claims, 7 Drawing Sheets

(56) References Cited

U.S. PATENT DOCUMENTS

| | | | | |
|---|---|---|---|---|
| 2019/0277577 | A1* | 9/2019 | Cao | F28F 1/006 |
| 2019/0360725 | A1 | 11/2019 | Kondou | |
| 2020/0033012 | A1* | 1/2020 | Nagashima | F24F 1/68 |
| 2020/0284476 | A1 | 9/2020 | Nishio et al. | |
| 2021/0055024 | A1 | 2/2021 | Hatomura | |
| 2021/0123637 | A1* | 4/2021 | Petersen | F25B 6/04 |

FOREIGN PATENT DOCUMENTS

| | | | | |
|---|---|---|---|---|
| JP | 2008-138921 | A | | 6/2008 |
| JP | 2010-112655 | A | | 5/2010 |
| JP | 2011-202939 | A | | 10/2011 |
| JP | 2012-26610 | | * | 2/2012 |
| JP | 2012-026610 | A | | 2/2012 |
| JP | 2012-247168 | A | | 12/2012 |
| JP | 2018-084375 | | * | 5/2018 |
| JP | 2018-084375 | A | | 5/2018 |
| KR | 10-2006-0071659 | | | 6/2006 |
| WO | 2018/198164 | A1 | | 11/2018 |
| WO | 2019/064441 | A1 | | 4/2019 |

OTHER PUBLICATIONS

Extended European Search Report dated Aug. 30, 2022 issued in corresponding European Patent Application No. 19940323.9.
Office Action dated May 24, 2022 issued in corresponding JP Patent Application No. 2021-538612 (and English Machine Translation).
International Search Report of the International Searching Authority mailed Oct. 1, 2019 for the corresponding international application No. PCT/JP2019/031085 (and English translation).

* cited by examiner

CHILLING UNIT

CROSS REFERENCE TO RELATED APPLICATION

This application is a U.S. national stage application of PCT/JP2019/031085 filed on Aug. 7, 2019, the contents of which are incorporated herein by reference.

TECHNICAL FIELD

The present disclosure relates to a chilling unit including an injection circuit through which liquid refrigerant is injected into a compressor.

BACKGROUND ART

A known chilling unit includes an injection circuit through which liquid refrigerant is injected into a compressor. Patent Literature 1 discloses an air-conditioning apparatus in which refrigerant liquefied in a refrigerant heat exchanger disposed between a heat-source-side expansion device and a load-side expansion device is injected into a compressor, Patent Literature 1 states that two-phase gas-liquid refrigerant reduced in pressure to an intermediate pressure by the heat-source-side expansion device or the load-side expansion device is liquefied in the refrigerant heat exchanger and is then injected into the compressor. As described in Patent Literature 1, the heat-source-side expansion device is disposed in a heat-source-side unit, and the load-side expansion device is disposed in a load-side unit. Such a configuration generally results in a large amount of refrigerant enclosed in an air-conditioning apparatus. In Patent Literature 1, the heat-source-side expansion device or the load-side expansion device reduces the pressure of the refrigerant to the intermediate pressure to provide two-phase gas-liquid refrigerant, thus achieving a reduction in the amount of refrigerant enclosed.

CITATION LIST

Patent Literature

Patent Literature 1: Japanese Unexamined Patent Application Publication No. 2008-138921

SUMMARY OF INVENTION

Technical Problem

As described above, in the air-conditioning apparatus disclosed in Patent Literature 1, the pressure of the refrigerant is reduced to the intermediate pressure by the heat-source-side expansion device or the load-side expansion device. Therefore, an additional circuit with, for example, the refrigerant heat exchanger, is needed to inject liquid refrigerant into the compressor.

To solve the above issue, the present disclosure has been made aiming at providing a chilling unit that eliminates the need for a circuit to generate liquid refrigerant that is to be injected.

Solution to Problem

A chilling unit according to an embodiment of the present disclosure includes a casing, a refrigerant circuit in which a compressor, a heat-source heat exchanger, a first expansion unit, a second expansion unit, and a refrigerant-to-heat medium heat exchanger are connected by a refrigerant pipe and through which refrigerant flows, the refrigerant circuit being placed in the casing, and an injection circuit in which a portion between the first expansion unit and the second expansion unit is connected to the compressor by an injection pipe, the injection circuit being placed in the casing.

Advantageous Effects of Invention

According to the embodiment of the present disclosure, the refrigerant circuit and the injection circuit are placed in the casing. Such a configuration results in a small amount of refrigerant enclosed in the refrigerant circuit. This eliminates the need for a further reduction in the amount of refrigerant enclosed. It is therefore unnecessary to liquefy refrigerant that is to be injected into the compressor. Thus, the chilling unit eliminates the need for a circuit to generate liquid refrigerant.

DESCRIPTION OF EMBODIMENTS

Embodiments of a chilling unit according to the present disclosure will be described below with reference to the drawings. Note that the following embodiments should not be construed as limiting the present disclosure. Furthermore, note that the relationship between the sizes of components in the following figures including FIG. 1 may differ from that between the actual sizes of the components. For the sake of easy understanding, terms representing directions will be used as appropriate. These terms are used herein only for the purpose of convenience of description, and should not be construed as limiting the present disclosure. Examples of the terms representing the directions include "upper", "lower", "right", "left", "front", and "rear".

Embodiment 1

Figure 1:
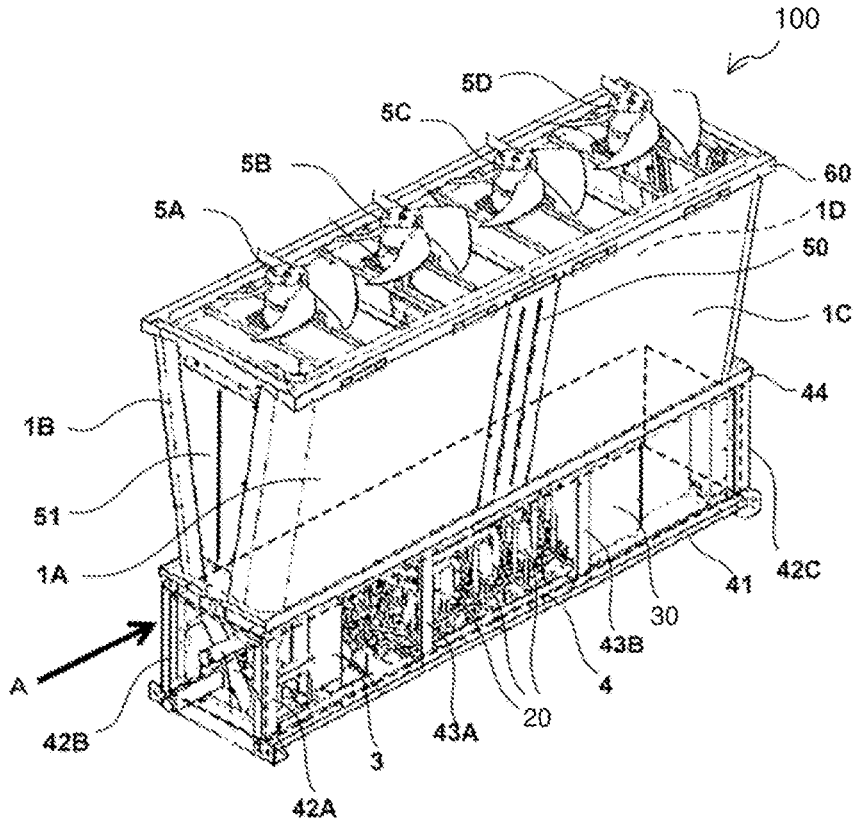
FIG. 1 is a perspective view of a chilling unit according to Embodiment 1.
Figure 2:
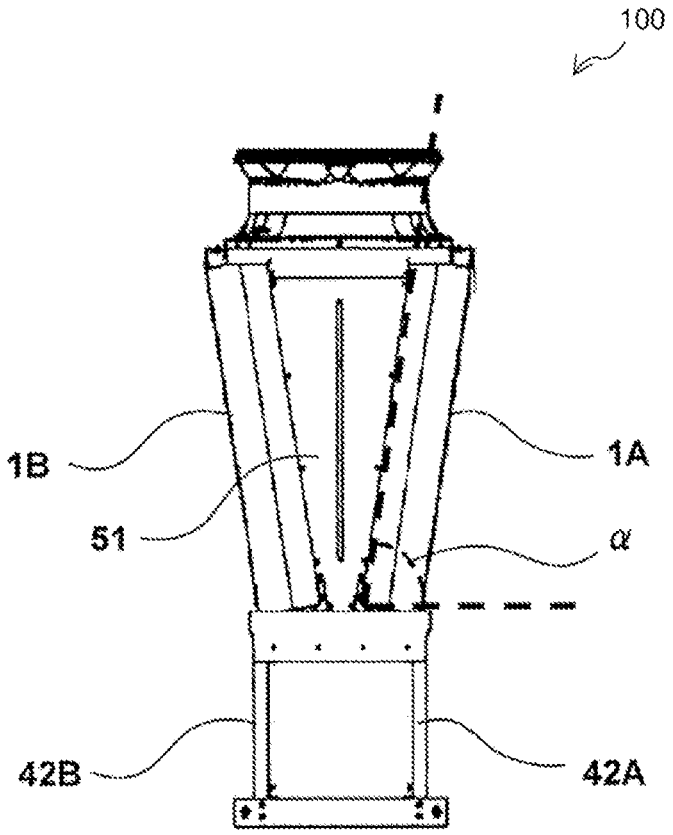
FIG. 2 is a side view of the chiding unit according to Embodiment 1.
Figure 3:
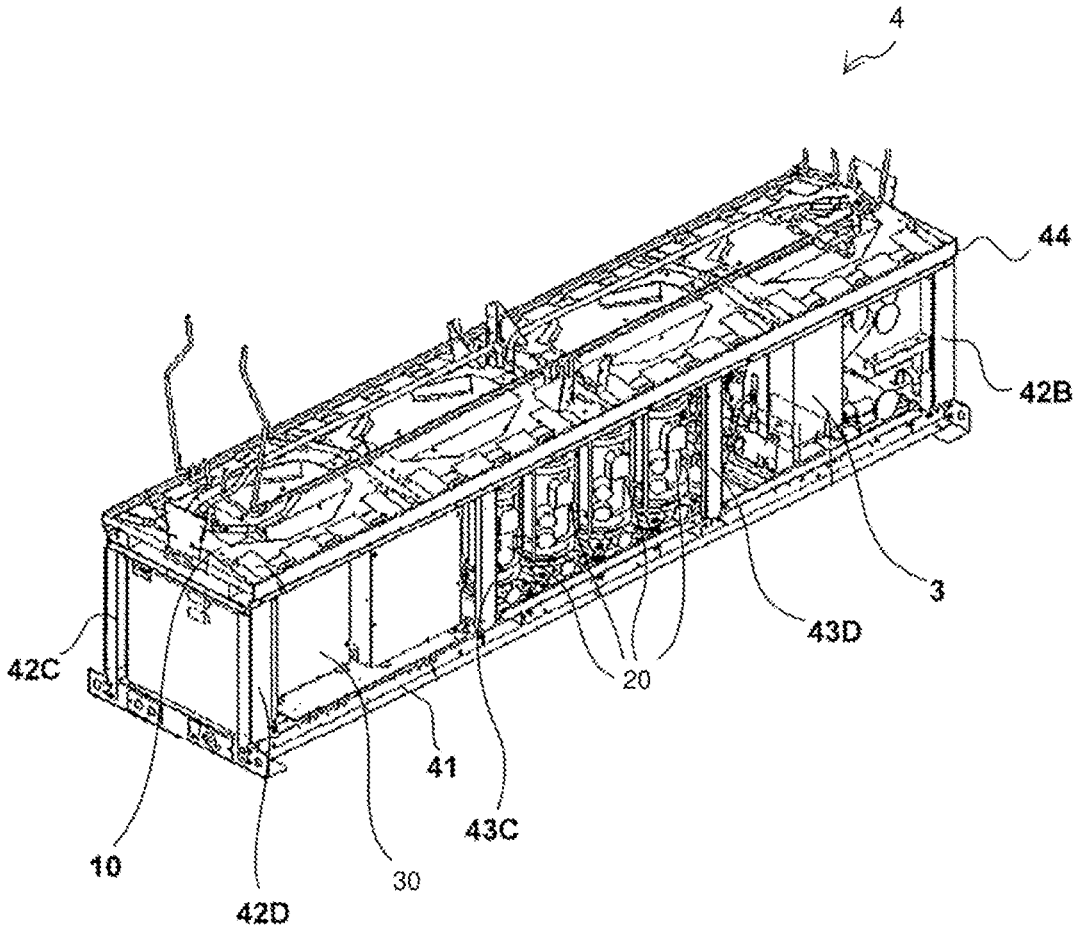
FIG. 3 is a perspective view of a machine chamber illustrating the chilling unit according to Embodiment 1.
Figure 4:
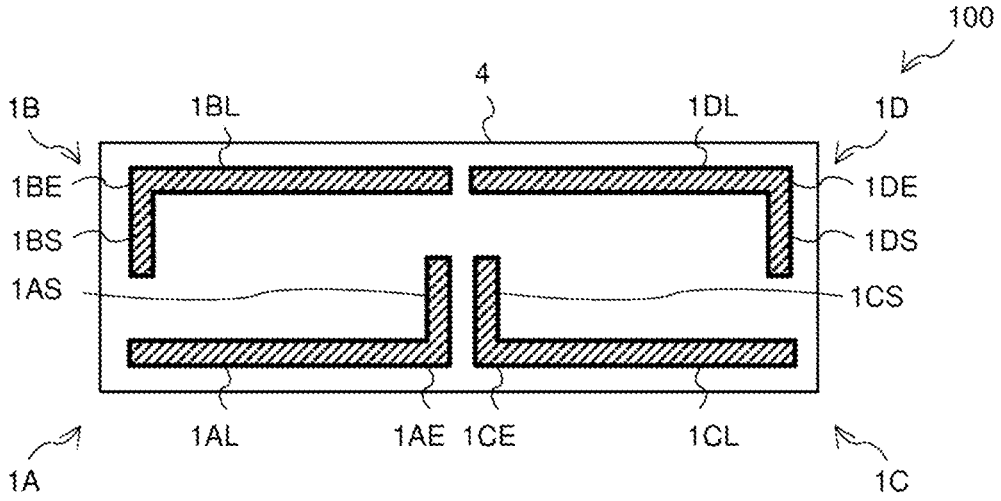
FIG. 4 is a schematic diagram illustrating the placement of a first heat-source heat exchanger in the chilling unit according to Embodiment 1.

FIG. 1 is a perspective view of a chilling unit 100 according to Embodiment 1. FIG. 2 is a side view of the chilling unit 100 according to Embodiment 1. FIG. 3 is a perspective view of a machine chamber 4 illustrating the chilling unit 100 according to Embodiment 1. FIG. 4 is a schematic diagram illustrating the placement of a first heat-source heat exchanger 1A in the chilling unit 100 according to Embodiment 1. FIG. 2 illustrates the chilling unit 100 as viewed in the direction of an arrow A in FIG. 1. FIG. 3 illustrates the machine chamber 4 as viewed from where the opposite side of the chilling unit from that illustrated in FIG.

2 is disposed. FIG. 4 illustrates the first heat-source heat exchanger 1A, a second heat-source heat exchanger 1B, a third heat-source heat exchanger 1C, and a fourth heat-source heat exchanger 1D as viewed from above the chilling unit 100. The chilling unit 100 according to Embodiment 1 receives a heat medium, such as water or antifreeze, from a use-side unit (not illustrated). The heat medium is cooled or heated in the chilling unit 100 and is then sent and supplied to the use-side unit. The circulation of the heat medium causes the use-side unit to be supplied with cooling energy or heating energy.

As illustrated in FIGS. 1 to 4, the chilling unit 100 includes, in a casing 1, the first heat-source heat exchanger 1A, the second heat-source heat exchanger 1B, the third heat-source heat exchanger 1D, and the fourth heat-source heat exchanger 1D, which are included in a refrigeration cycle on a heat source side. The first heat-source heat exchanger 1A, the second heat-source heat exchanger 1B, the third heat-source heat exchanger 1C, and the fourth heat-source heat exchanger 1D may be referred to as a heat-source heat exchanger 2. The chilling unit 100 further includes a first fan 5A, a second fan 5B, a third fan 5C, and a fourth fan 5C. The first fan 5A, the second fan 5B, the third fan 5C, and the fourth fan 5D may be referred to as a fan 5. The chilling unit 100 has the machine chamber 4, which has a cuboid shape.

A top frame 60 is disposed above the first heat-source heat exchanger 1A, the second heat-source heat exchanger 1B, the third heat-source heat exchanger 1C, and the fourth heat-source heat exchanger 1D, The top frame 60 has the first fan 5A, the second fan 5B, the third fan 5C, and the fourth fan 5C. Each of the first fan 5A, the second fan 5B, the third fan 5C, and the fourth fan 5D is covered with a fan guard (not illustrated).

In FIG. 1, a dashed line represents a space occupied by the machine chamber 4. The machine chamber 4 has a support 41, four pillars, four intermediate columns, and an upper beam 44. The four pillars are a pillar 42A, a pillar 42B, a pillar 42C, and a pillar 42D. The four intermediate columns are an intermediate column 43A, an intermediate column 43B, an intermediate column 43C, and an intermediate column 43D. The support 41 is a rectangular flat part. The pillars 42A, 42B, 42C, and 42D are arranged at four corners of the support 41 and extend perpendicularly to the support 41. The intermediate columns 43A and 43B are spaced apart between the pillars 42A and 42C in a longitudinal direction of the support 41.

The intermediate columns 43C and 43D are spaced apart between the pillars 42B and 42D in the longitudinal direction of the support 41. The intermediate columns 43A, 43B, 43C, and 43D extend perpendicularly to the support 41. The upper beam 44 is disposed on the pillars 42A, 42B, 42C, and 42D and the intermediate columns 43A, 43B, 43C, and 43D. The machine chamber 4 contains multiple element devices. The devices contained in the machine chamber 4 include a refrigerant-to-heat medium heat exchanger 3, a compressor 20 included in a refrigerant circuit 19, and a control unit 30. The pillars 42A, 42B, 42C, and 42D may be collectively referred to as pillars 42. Additionally, the intermediate columns 43A, 43B, 43C, and 43D may be collectively referred to as intermediate columns 43.

Furthermore, as illustrated in FIG. 2, the first heat-source heat exchanger 1A and the second heat-source heat exchanger 1B facing each other in a lateral direction of the machine chamber 4 are inclined such that the distance between ends of the heat exchangers remote from the machine chamber 4 is larger than the distance between ends of the heat exchangers adjacent to the machine chamber 4. In other words, the first heat-source heat exchanger 1A and the second heat-source heat exchanger 1B are inclined to form a V-shape as viewed from the side of the chilling unit 100. The third heat-source heat exchanger 1D and the fourth heat-source heat exchanger 1D facing each other in the lateral direction of the machine chamber 4 are also similarly inclined to form a V-shape. In Embodiment 1, the first heat-source heat exchanger 1A is inclined at an angle $\alpha$ of from 65 to 80 degrees. The second heat-source heat exchanger 1B, the third heat-source heat exchanger 1C, and the fourth heat-source heat exchanger 1D are inclined at the same angle as the angle $\alpha$.

As illustrated in FIG. 3, the upper beam 44 of the machine chamber 4 has a base 10. The base 10 is supported by the pillars 42 and the intermediate columns 43. The base 10 has multiple rubber sheets. The first heat-source heat exchanger 1A, the second heat-source heat exchanger 1B, the third heat-source heat exchanger 1C, and the fourth heat-source heat exchanger 1D are arranged on the base 10, with the rubber sheets placed therebetween. The first heat-source heat exchanger 1A, the second heat-source heat exchanger 1B, the third heat-source heat exchanger 1D, and the fourth heat-source heat exchanger 1D are inclined in the above-described manner. A side panel 50 is disposed between the first heat-source heat exchanger 1A and the third heat-source heat exchanger 1C, A side panel 51 is disposed between the first heat-source heat exchanger 1A and the second heat-source heat exchanger 1B, In addition, a side panel (not illustrated) similar to the side panel 50 is disposed between the second heat-source heat exchanger 1B and the fourth heat-source heat exchanger 1D. Additionally, a side panel (not illustrated) similar to the side panel 51 is disposed between the third heat-source heat exchanger 1D and the fourth heat-source heat exchanger 1D.

The first heat-source heat exchanger 1A, the second heat-source heat exchanger 1B, the third heat-source heat exchanger 1D, and the fourth heat-source heat exchanger 1D are parallel-flow heat exchangers, and each include a pair of headers, multiple aluminum flat tubes, and multiple corrugated fins. The aluminum flat tubes are arranged between the pair of headers and are connected at opposite ends to the headers. The aluminum flat tubes are spaced apart parallel to each other between the pair of headers such that flat portions of the tubes face each other. The corrugated fins are arranged between the facing flat portions of the aluminum flat tubes.

As illustrated in FIG. 4, the first to fourth heat-source heat exchangers 1A to 1D are bent at an angle of 90 degrees such that, when viewed in a direction orthogonal to the aluminum flat tubes, a portion of each aluminum flat tube that is located at a slight distance from the middle thereof in a longitudinal direction thereof is bent. In other words, the first heat-source heat exchanger 1A, the second heat-source heat exchanger 1B, the third heat-source heat exchanger 1C, and the fourth heat-source heat exchanger 1D are L-shaped when viewed from where first ends of the headers are located. The first heat-source heat exchanger 1A faces the second heat-source heat exchanger 1B in the lateral direction of the machine chamber 4. The third heat-source heat exchanger 1C faces the fourth heat-source heat exchanger 1D in the lateral direction of the machine chamber 4. The first heat-source heat exchanger 1A and the third heat-source heat exchanger 1D are arranged side by side in the longitudinal direction of the machine chamber 4. The second heat-source heat exchanger 1B and the fourth heat-source heat exchanger 1D are arranged side by side in the longitudinal direction of the machine chamber 4.

Furthermore, a short side portion 1AS of the first heat-source heat exchanger 1A faces a short side portion 1BS of the second heat-source heat exchanger 1B in the longitudinal direction of the machine chamber 4. A short side portion 1CS of the third heat-source heat exchanger 1C faces a short side portion 1DS of the fourth heat-source heat exchanger 1D in the longitudinal direction of the machine chamber 4. In addition, a long side portion 1AL of the first heat-source heat exchanger 1A and a long side portion 1CL of the third heat-source heat exchanger 1C are arranged side by side in the longitudinal direction of the machine chamber 4. A long side portion 1BL of the second heat-source heat exchanger 1B and a long side portion 1DL of the fourth heat-source heat exchanger 1D are arranged side by side in the longitudinal direction of the machine chamber 4. The first heat-source heat exchanger 1A and the second heat-source heat exchanger 1B arranged in the above-described manner form a rectangle. An edge 1AE, along which the short side portion 1AS and the long side portion 1AL meet, of the first heat-source heat exchanger 1A is located at one corner of the rectangle. An edge 1BE, along which the short side portion 1BS and the long side portion 1BL meet, of the second heat-source heat exchanger 1B is located at one corner of the rectangle. Furthermore, the third heat-source heat exchanger 1D and the fourth heat-source heat exchanger 1D form a rectangle. An edge 1CE, along which the short side portion 1CS and the long side portion 1CL meet, of the third heat-source heat exchanger 1D is located at one corner of the rectangle. An edge 1DE, along which the short side portion 1DS and the long side portion 1DL meet, of the fourth heat-source heat exchanger 1D is located at one corner of the rectangle. The arrangement of the heat-source heat exchangers in FIG. 4 is merely an example. The heat-source heat exchangers may be arranged in a different manner.

In the chilling unit 100 according to Embodiment 1, incoming air flows in a direction orthogonal to long sides of the aluminum flat tubes of the first heat-source heat exchanger 1A, the second heat-source heat exchanger 1B, the third heat-source heat exchanger 1D, and the fourth heat-source heat exchanger 1D. Therefore, the incoming air is guided to spaces between the facing flat portions of the aluminum flat tubes, and flows in a direction along the width of the aluminum flat tubes, or orthogonally to the longitudinal direction of the aluminum flat tubes.

Figure 5:
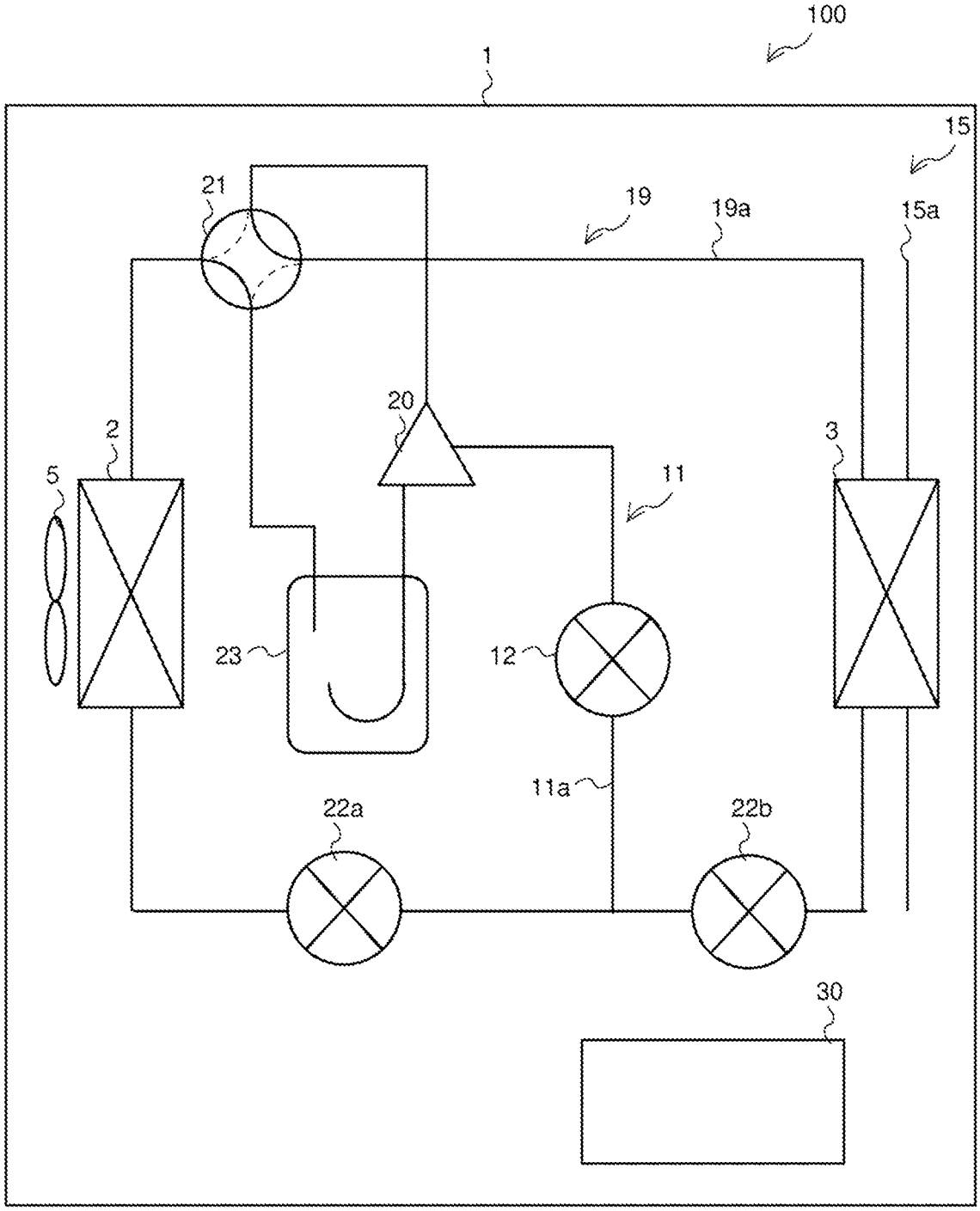
FIG. 5 is a circuit diagram illustrating the chilling unit according to Embodiment 1.

FIG. 5 is a circuit diagram illustrating the chilling unit 100 according to Embodiment 1. As illustrated in FIG. 5, the chilling unit 100 includes the casing 1, the refrigerant circuit 19, an injection circuit 11, a heat medium circuit 15, and the control unit 30. The refrigerant circuit 19, the injection circuit 11, the heat medium circuit 15, and the control unit 30 are placed in the casing 1.

(Refrigerant Circuit 19)

The compressor 20, a flow switching device 21, the heat-source heat exchanger 2, a first expansion unit 22*a*, a second expansion unit 22*b*, the refrigerant-to-heat medium heat exchanger 3, and an accumulator 23 are connected by a refrigerant pipe 19*a*, thus forming the refrigerant circuit 19. The compressor 20 sucks low-temperature, low-pressure refrigerant, compresses the sucked refrigerant into high-temperature, high-pressure refrigerant, and discharges the refrigerant. The flow switching device 21 switches between refrigerant flow directions in the refrigerant circuit 19. The flow switching device 21 is, for example, a four-way valve. The flow switching device 21 is connected to the compressor 20, and switches the direction of flow of refrigerant through the refrigerant circuit 19 to that for a cooling operation or a heating operation. The heat-source heat exchanger 2 is an air heat exchanger that exchanges heat between refrigerant and, for example, outdoor air. The heat-source heat exchanger 2 operates as a condenser in the cooling operation and operates as an evaporator in the heating operation. The casing 1 contains the fan 5. The fan 5 is a device that sends the outdoor air to the heat-source heat exchanger 2.

The first expansion unit 22*a* is a pressure reducing valve or expansion valve that reduces the pressure of refrigerant to expand the refrigerant. The first expansion unit 22*a* is, for example, an electronic expansion valve whose opening degree is adjustable. The second expansion unit 22*b* is a pressure reducing valve or expansion valve that reduces the pressure of refrigerant to expand the refrigerant. The second expansion unit 22*b* is, for example, an electronic expansion valve whose opening degree is adjustable. The refrigerant-to-heat medium heat exchanger 3 exchanges heat between the heat medium flowing through the heat medium circuit 15 and the refrigerant. The refrigerant-to-heat medium heat exchanger 3 operates as an evaporator in the cooling operation and operates as a condenser in the heating operation.

The distance between the first expansion unit 22*a* and the second expansion unit 22*b* is 1 m or less. In the chilling unit 100, the compressor 20, the flow switching device 21, the heat-source heat exchanger 2, the first expansion unit 22*a*, the second expansion unit 22*b*, the refrigerant-to-heat medium heat exchanger 3, and the accumulator 23 are placed in the single casing 1. This placement allows a reduction in length of the refrigerant pipe 19*a* included in the refrigerant circuit 19. This also allows the distance between the first expansion unit 22*a* and the second expansion unit 22*b* to be 1 m or less. The accumulator 23, which is disposed on a suction side of the compressor 20, stores liquid refrigerant of the refrigerant to be sucked into the compressor 20 so that gas refrigerant alone enters the compressor 20.

(Injection Circuit 11)

A portion between the first expansion unit 22*a* and the second expansion unit 22*b* is connected to the compressor 20 by an injection pipe 11*a*, thus forming the injection circuit 11. The injection circuit 11 includes an injection expansion unit 12, which reduces the pressure of refrigerant flowing through the injection pipe 11*a* to expand the refrigerant. In the injection circuit 11 in Embodiment 1, which uses a suction chamber injection method, the injection pipe 11*a* communicates with a suction chamber of the compressor 20.

For an intermediate injection method in which intermediate-pressure and low-duality refrigerant is injected into the compressor 20 during compression, an increase in volume depends on the distance between the compressor 20 and an expansion unit, leading to lower volumetric efficiency. It is therefore necessary to dispose the expansion unit in the vicinity of the compressor 20. In this case, stress from the compressor 20 may affect the expansion unit. In contrast, Embodiment 1 uses the suction chamber injection method, which allows for high volumetric efficiency and enables the first expansion unit 22*a* and the second expansion unit 22*b* to be located away from the compressor 20. This eliminates the need for a measure against stress.

(Heat Medium Circuit 15)

The refrigerant-to-heat medium heat exchanger 3 is connected to the use-side unit by a heat medium pipe 15*a*, thus forming the heat medium circuit 15.

(Control Unit 30)

The control unit 30 is configured as dedicated hardware or a central processing unit (CPU) (also called a processing unit, an arithmetic unit, a microprocessor, a microcomputer, or a processor) that runs a program stored in a storage device. In the case where the control unit 30 is dedicated hardware, the control unit 30 corresponds to, for example, a single circuit, a composite circuit, an application specific integrated circuit (ASIC), a field-programmable gate array (FPGA), or a combination thereof. Functional parts that the control unit 30 implements may be implemented by individual hardware components or may be implemented by a single hardware component.

In the case where the control unit 30 is a CPU, functions that the control unit 30 performs are implemented by software, firmware, or a combination of software and firmware. Software and firmware are described as programs and are stored in the storage device. The CPU reads the programs stored in the storage device and runs the programs, thus implementing the functions. A subset of the functions of the control unit 30 may be implemented by dedicated hardware, and another subset thereof may be implemented by software or firmware. The storage device may be configured as a hard disk or a volatile storage device capable of temporarily storing data, for example, a random access memory (RAM). The storage device may be configured as a nonvolatile storage device capable of storing data for a long time, for example, a flash memory.

Operation modes of the chilling unit 100 according to Embodiment 1 include a cooling operation mode and a heating operation mode. In the cooling operation, the control unit 30 fully opens the first expansion unit 22*a* to adjust the opening degree of the second expansion unit 22*b*. In the cooling operation, the heat-source heat exchanger 2 condenses and liquefies the refrigerant. The liquid refrigerant, while being in a liquid state, flows out of the first expansion unit 22*a*, which is fully opened. Part of the liquid refrigerant flows through the injection pipe 11*a* and is then injected into the compressor 20. In the chilling unit 100, the refrigerant circuit 19 and the injection circuit 11 are placed in the casing 1. Such a configuration results in a small amount of refrigerant enclosed in the refrigerant circuit. This eliminates the need for a further reduction in the amount of refrigerant enclosed. Therefore, the first expansion unit 22*a* does not need to turn the liquid refrigerant into two-phase gas-liquid refrigerant. Thus, the first expansion unit 22*a* can be fully opened. For the other part of the liquid refrigerant, or the refrigerant other than the refrigerant flowing through the injection pipe 11*a*, the degree of superheat of the refrigerant is controlled in the second expansion unit 22*b*.

Furthermore, in the heating operation, the control unit 30 fully opens the second expansion unit 22*b* to adjust the opening degree of the first expansion unit 22*a*. In the heating operation, the refrigerant-to-heat medium heat exchanger 3 condenses and liquefies the refrigerant. The liquid refrigerant, while being in the liquid state, flows out of the second expansion unit 22*b*, which is fully opened. Part of the liquid refrigerant flows through the injection pipe 11*a* and is then injected into the compressor 20. In the chilling unit 100, the refrigerant circuit 19 and the injection circuit 11 are placed in the casing 1. This configuration results in a small amount of refrigerant enclosed in the refrigerant circuit. This eliminates the need for a further reduction in the amount of refrigerant enclosed. Therefore, the second expansion unit 22*b* does not need to turn the liquid refrigerant into two-phase gas-liquid refrigerant. Thus, the second expansion unit 22*b* can be fully opened. For the other part of the liquid refrigerant, or the refrigerant other than the refrigerant flowing through the injection pipe 11*a*, the degree of superheat of the refrigerant is controlled in the first expansion unit 22*a*.

(Operation Mode, Cooling Operation)

Figure 6:
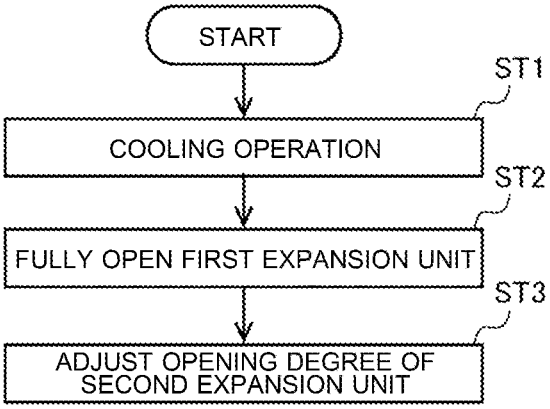
FIG. 6 is a flowchart illustrating an operation of a control unit in Embodiment 1.

FIG. 6 is a flowchart illustrating an operation of the control unit 30 in Embodiment 1, The operation of the control unit 30 will now be described with reference to the flowchart. As illustrated in FIG. 6, when the cooling operation is started (step ST1), the control unit 30 fully opens the first expansion unit 22*a* (step ST2). Then, the control unit 30 adjusts the opening degree of the second expansion unit 22*b* to adjust the temperature of the refrigerant (step ST3).

The flow of the refrigerant in the cooling operation will now be described. In the cooling operation, the refrigerant sucked into the compressor 20 is compressed into high-temperature and high-pressure gas refrigerant by the compressor 20 and is then discharged therefrom. The high-temperature and high-pressure gas refrigerant discharged from the compressor 20 passes through the flow switching device 21 and enters the heat-source heat exchanger 2 operating as a condenser. In the heat-source heat exchanger 2, the refrigerant exchanges heat with the outdoor air sent by the fan 5 and thus condenses into liquid. The condensed liquid refrigerant then enters the first expansion unit 22*a* fully opened and then flows out thereof while remaining unchanged. The liquid refrigerant is divided into two streams. One stream of the refrigerant enters the second expansion unit 22*b*. The refrigerant is expanded and reduced in pressure into low-temperature and low-pressure, two-phase gas-liquid refrigerant by the second expansion unit 22*b*. Then, the two-phase gas-liquid refrigerant enters the refrigerant-to-heat medium heat exchanger 3 operating as an evaporator. In the refrigerant-to-heat medium heat exchanger 3, the refrigerant exchanges heat with the heat medium flowing through the heat medium pipe 15*a* and thus evaporates into gas. At this time, the heat medium is cooled. The evaporated, low-temperature, low-pressure gas refrigerant passes through the flow switching device 21 and is then sucked into the compressor 20.

Part of the liquid refrigerant leaving the first expansion unit 22*a* flows through the injection pipe 11*a* and is then expanded and reduced in pressure by the injection expansion unit 12. The refrigerant expanded and reduced in pressure is then sucked into the suction chamber of the compressor 20.

(Operation Mode, Heating Operation)

Figure 7:
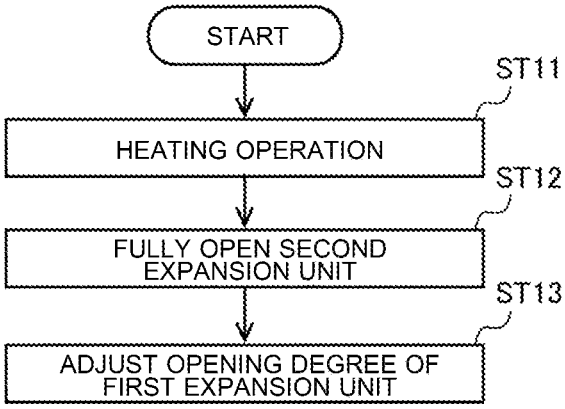
FIG. 7 is a flowchart illustrating an operation of the control unit in Embodiment 1.

FIG. 7 is a flowchart illustrating an operation of the control unit 30 in Embodiment 1. The operation of the control unit 30 will now be described with reference to the flowchart. As illustrated in FIG. 7, when the heating operation is started (step ST11), the control unit 30 fully opens the second expansion unit 22*b* (step ST12). Then, the control unit 30 adjusts the opening degree of the first expansion unit 22*a* to adjust the temperature of the refrigerant (step ST13).

The flow of the refrigerant in the heating operation will now be described. In the heating operation, the refrigerant sucked into the compressor 20 is compressed into high-temperature and high-pressure gas refrigerant by the compressor 20 and is then discharged therefrom. The high-temperature, high-pressure gas refrigerant discharged from the compressor 20 passes through the flow switching device 21 and enters the refrigerant-to-heat medium heat exchanger 3 operating as a condenser. In the refrigerant-to-heat medium heat exchanger 3, the refrigerant exchanges heat with the heat medium flowing through the heat medium pipe 15*a* and thus condenses into liquid. At this time, the heat medium is heated. The condensed liquid refrigerant then enters the second expansion unit 22*b* fully opened and then flows out thereof while remaining unchanged. The liquid refrigerant is divided into two streams. One stream of the refrigerant enters the first expansion unit 22*a*. The refrigerant is expanded and reduced in pressure into low-temperature, low-pressure and two-phase gas-liquid refrigerant by the first expansion unit 22*a*. Then, the two-phase gas-liquid refrigerant enters the heat-source heat exchanger 2 operating as an evaporator. In the heat-source heat exchanger 2, the refrigerant exchanges heat with the outdoor air sent by the fan 5 and thus evaporates into gas. The evaporated, low-temperature and low-pressure gas refrigerant passes through the flow switching device 21 and is then sucked into the compressor 20.

Part of the liquid refrigerant leaving the second expansion unit 22*b* flows through the injection pipe 11*a* and is then expanded and reduced in pressure by the injection expansion unit 12. The refrigerant expanded and reduced in pressure is then sucked into the suction chamber of the compressor 20.

In Embodiment 1, the refrigerant circuit 19 and the injection circuit 11 are placed in the casing 1. This configuration results in a small amount of refrigerant enclosed in the refrigerant circuit 19. This eliminates the need for a further reduction in the amount of refrigerant enclosed. It is therefore unnecessary to liquefy the refrigerant to be injected into the compressor 20. Thus, the chilling unit 100 eliminates the need for a circuit to generate liquid refrigerant. As described above, in Embodiment 1, the first expansion unit 22*a* and the second expansion unit 22*b*, which are relatively inexpensive, may be placed instead of a circuit to generate liquid refrigerant, resulting in a reduction in cost.

The distance between the first expansion unit 22*a* and the second expansion unit 22*b* is 1 m or less. In the chilling unit 100, the compressor 20, the flow switching device 21, the heat-source heat exchanger 2, the first expansion unit 22*a*, the second expansion unit 22*b*, the refrigerant-to-heat medium heat exchanger 3, and the accumulator 23 are placed in the single casing 1. This placement allows a reduction in length of the refrigerant pipe 19*a* included in the refrigerant circuit 19. This also allows the distance between the first expansion unit 22*a* and the second expansion unit 22*b* to be 1 m or less.

The injection pipe 11*a* communicates with the suction chamber of the compressor 20. For the intermediate injection method in which intermediate-pressure and low-quality refrigerant is injected into the compressor 20 during compression, an increase in volume depends on the distance between the compressor 20 and an expansion unit, leading to lower volumetric efficiency. It is therefore necessary to dispose the expansion unit in the vicinity of the compressor 20. In this case, stress from the compressor 20 may affect the expansion unit. In contrast, Embodiment 1 uses the suction chamber injection method, which allows for high volumetric efficiency and enables the first expansion unit 22*a* and the second expansion unit 22*b* to be located away from the compressor 20. This eliminates the need for a measure against stress. For a suction pipe injection method, in which liquid refrigerant flows into a suction pipe disposed on the suction side of the compressor 20, oil may be diluted. In contrast, Embodiment 1 uses the suction chamber injection method, which can inhibit an excessive increase in discharge temperature of the refrigerant without any dilution of oil.

In the cooling operation, the heat-source heat exchanger 2 condenses and liquefies the refrigerant. The liquid refrigerant, while being in the liquid state, flows out of the first expansion unit 22*a*, which is fully opened. Part of the liquid refrigerant flows through the injection pipe 11*a* and is then injected into the compressor 20. In the chilling unit 100, the refrigerant circuit 19 and the injection circuit 11 are placed in the casing 1. This configuration results in a small amount of refrigerant enclosed in the refrigerant circuit. This eliminates the need for a further reduction in the amount of refrigerant enclosed. Therefore, the first expansion unit 22*a* does not need to turn the liquid refrigerant into two-phase gas-liquid refrigerant. Thus, the first expansion unit 22*a* can be fully opened.

In the heating operation, the refrigerant-to-heat medium heat exchanger 3 condenses and liquefies the refrigerant. The liquid refrigerant, while being in the liquid state, flows out of the second expansion unit 22*b*, which is fully opened. Part of the liquid refrigerant flows through the injection pipe 11*a* and is then injected into the compressor 20. In the chilling unit 100, the refrigerant circuit 19 and the injection circuit 11 are placed in the casing 1. This configuration results in a small amount of refrigerant enclosed in the refrigerant circuit. This eliminates the need for a further reduction in the amount of refrigerant enclosed. Therefore, the first expansion unit 22*a* does not need to turn the liquid refrigerant into two-phase gas-liquid refrigerant. Thus, the first expansion unit 22*a* can be fully opened.

REFERENCE SIGNS LIST

1: casing, 1A: first heat-source heat exchanger, 1AE: edge, 1AL: long side portion, 1AS: short side portion, 1B: second heat-source heat exchanger, 1BE: edge, 1BL: long side portion, 1BS: short side portion, 10: third heat-source heat exchanger, 10E: edge, 1CL: long side portion, 1CS: short side portion, 1D: fourth heat-source heat exchanger, 1DE: edge, 1DL: long side portion, 1DS: short side portion, 2: heat-source heat exchanger, 3: refrigerant-to-heat medium heat exchanger, 4: machine chamber, 5: fan, 5A: first fan, 5B: second fan, 5C: third fan, 5D: fourth fan, 10: base, 11: injection circuit, 11*a*: injection pipe, 12: injection expansion unit, 15: heat medium circuit, 15*a*: heat medium pipe, 19: refrigerant circuit, 19*a*: refrigerant pipe, 20: compressor, 21: flow switching device, 22*a*: first expansion unit, 22*b*: second expansion unit, 23: accumulator, 30: control unit, 41: support, 42: pillars, 42A: pillar, 42B: pillar, 42C: pillar, 42D: pillar, 43: intermediate columns, 43A: intermediate column, 43B: intermediate column, 43C: intermediate column, 43D: intermediate column, 44: upper beam, 50: side panel, 51: side panel, 60: top frame, 100: chilling unit

The invention claimed is:

1. A chilling unit comprising:

a casing having a machine chamber:

a refrigerant circuit in which a compressor, a heat-source heat exchanger, a first expansion unit, a second expansion unit, and a refrigerant-to-heat medium heat exchanger are connected by a refrigerant pipe and through which refrigerant flows, the refrigerant circuit being placed in the casing;

an injection circuit in which a portion between the first expansion unit and the second expansion unit is connected to the compressor by an injection pipe, the injection circuit being placed in the casing; and a control unit comprising one of a processor and a circuit configured to fully open the first expansion unit and adjust an opening degree of the second expansion unit in a cooling operation, wherein the refrigerant-to-heat medium heat exchanger and the compressor are located in the machine chamber, and the heat-source heat exchanger is located on top of the machine chamber, the heat-source heat exchanger comprises a first heat-source heat exchanger, a second heat-source heat exchanger, a third heat-source heat exchanger, and a fourth heat-source heat exchanger, each of the first heat-source heat exchanger, the second heat-source heat exchanger, the third heat-source heat exchanger, and the fourth heat-source heat exchanger is L-shaped and comprises a short side portion and a long side portion, the long side portion of the first heat-source heat exchanger and the long side portion of the second heat-source heat exchanger face each other in a lateral direction of the machine chamber, the short side portion of the first heat-source heat exchanger and the short side portion of the second heat-source heat exchanger face each other in a longitudinal direction of the machine chamber, the long side portion of the third heat-source heat exchanger and the long side portion of the fourth heat-source heat exchanger face each other in the lateral direction of the machine chamber, and the short side portion of the third heat-source heat exchanger and the short side portion of the fourth heat-source heat exchanger face each other in the longitudinal direction of the machine chamber.

2. The chilling unit of claim 1, wherein a distance between the first expansion unit and the second expansion unit is 1 m or less.

3. The chilling unit of claim 1, wherein the injection pipe communicates with a suction chamber of the compressor.

4. A chilling unit comprising:

a casing having a machine chamber:

a refrigerant circuit in which a compressor, a heat-source heat exchanger, a first expansion unit, a second expansion unit, and a refrigerant-to-heat medium heat exchanger are connected by a refrigerant pipe and through which refrigerant flows, the refrigerant circuit being placed in the casing;

an injection circuit in which a portion between the first expansion unit and the second expansion unit is connected to the compressor by an injection pipe, the injection circuit being placed in the casing; and a control unit comprising one of a processor and a circuit configured to fully open the second expansion unit and adjust an opening degree of the first expansion unit in a heating operation, wherein the refrigerant-to-heat medium heat exchanger and the compressor are located in the machine chamber, and the heat-source heat exchanger is located on top of the machine chamber, the heat-source heat exchanger comprises a first heat-source heat exchanger, a second heat-source heat exchanger, a third heat-source heat exchanger, and a fourth heat-source heat exchanger, each of the first heat-source heat exchanger, the second heat-source heat exchanger, the third heat-source heat exchanger, and the fourth heat-source heat exchanger is L-shaped and comprises a short side portion and a long side portion, the long side portion of the first heat-source heat exchanger and the long side portion of the second heat-source heat exchanger face each other in a lateral direction of the machine chamber, the short side portion of the first heat-source heat exchanger and the short side portion of the second heat-source heat exchanger face each other in a longitudinal direction of the machine chamber, the long side portion of the third heat-source heat exchanger and the long side portion of the fourth heat-source heat exchanger face each other in the lateral direction of the machine chamber, and the short side portion of the third heat-source heat exchanger and the short side portion of the fourth heat-source heat exchanger face each other in the longitudinal direction of the machine chamber.

5. The chilling unit of claim 1, wherein the first heat-source heat exchanger and the second heat-source heat exchanger are inclined such that a distance between an end of the first heat-source heat exchanger adjacent to the machine chamber and an end of the second heat-source heat exchanger adjacent to the machine chamber is smaller than a distance between an end of the first heat-source heat exchanger remote from the machine chamber and an end of the second heat-source heat exchanger remote from the machine chamber, and the third heat-source heat exchanger and the fourth heat-source heat exchanger are inclined such that a distance between an end of the third heat-source heat exchanger adjacent to the machine chamber and an end of the fourth heat-source heat exchanger adjacent to the machine chamber is smaller than a distance between an end of the third heat-source heat exchanger remote from the machine chamber and an end of the fourth heat-source heat exchanger remote from the machine chamber.

6. The chilling unit of claim 5, wherein the first heat-source heat exchanger, the second heat-source heat exchanger, the third heat-source heat exchanger, and the fourth heat-source heat exchanger are each inclined at an angle between 65 degrees and 80 degrees from horizontal.

7. The chilling unit of claim 4, wherein the first heat-source heat exchanger and the second heat-source heat exchanger are inclined such that a distance between an end of the first heat-source heat exchanger adjacent to the machine chamber and an end of the second heat-source heat exchanger adjacent to the machine chamber is smaller than a distance between an end of the first heat-source heat exchanger remote from the machine chamber and an end of the second heat-source heat exchanger remote from the machine chamber, and the third heat-source heat exchanger and the fourth heat-source heat exchanger are inclined such that a distance between an end of the third heat-source heat exchanger adjacent to the machine chamber and an end of the fourth heat-source heat exchanger adjacent to the machine chamber is smaller than a distance between an end of the third heat-source heat exchanger remote from the machine chamber and an end of the fourth heat-source heat exchanger remote from the machine chamber.

8. The chilling unit of claim 7, wherein the first heat-source heat exchanger, the second heat-source heat exchanger, the third heat-source heat exchanger, and the fourth heat-source heat exchanger are each inclined at an angle between 65 degrees and 80 degrees from horizontal.

* * * * *